US005408790A

United States Patent [19]

Hoesten et al.

[11] Patent Number: 5,408,790

[45] Date of Patent: Apr. 25, 1995

[54] MODULAR DOCK SYSTEM

[75] Inventors: Mark Hoesten, Dallas, Tex.; Stephen J. Spencer, Provo, Utah

[73] Assignee: NCH Corporation, Irving, Tex.

[21] Appl. No.: 160,962

[22] Filed: Dec. 2, 1993

[51] Int. Cl.[6] ..... E04B 1/00

[52] U.S. Cl. ..... 52/263; 52/169.9

[58] Field of Search ..... 52/78, 87, 263, 177, 52/581, 582.2, 13, 656.1, 299, 301, 126.5, 169.12, 169.9; 14/69.5, 73, ; 404/2, 3; 137/312, 356, 362

[56] References Cited

U.S. PATENT DOCUMENTS

| | | | |
|---|---|---|---|
| 3,541,798 | 11/1970 | Schnabel, Jr. | 52/169.9 X |
| 3,999,397 | 12/1976 | Albery | 61/48 |
| 4,104,835 | 8/1978 | Bardwick, III | 52/7 |
| 4,580,776 | 4/1986 | Burkinshaw | 272/3 |
| 4,622,792 | 11/1986 | Betts | 52/263 |
| 4,676,036 | 6/1987 | Bessert | 52/126.6 |
| 4,679,590 | 7/1987 | Hergenroeder | 137/317 X |
| 4,759,162 | 7/1988 | Wyse | 52/126.6 |
| 4,823,529 | 4/1989 | Canfield et al. | 52/263 |
| 4,912,887 | 4/1990 | Sullivan | 52/7 |
| 5,213,438 | 5/1993 | Bärenward | 404/2 |
| 5,214,817 | 6/1993 | Allen | 14/69.5 |
| 5,301,722 | 4/1994 | Todd et al. | 137/312 X |

*Primary Examiner*—Carl D. Friedman
*Assistant Examiner*—Creighton Smith
*Attorney, Agent, or Firm*—Ross, Clapp, Korn & Montgomery

[57] ABSTRACT

A modular dock system (10) having a plurality of interconnected dock modules (12), each module having a rectangular frame with means (62) for supporting a metal grate (34) around its periphery, a drain pan (60) suspended from the frame beneath the grate, and an angular leg (24) at each corner of the frame, the modules being joined by vertically spaced bolts (64) interconnecting the abutting legs of adjacent modules. The system preferably includes a secondary containment system (14) having flow lines that gather spillage or leakage from the drain pan (60) of each module. A modular dock bumper assembly (16) is also disclosed for use with the modular dock system (10).

14 Claims, 4 Drawing Sheets

MODULAR DOCK SYSTEM

BACKGROUND OF THE INVENTION

1. Field of the Invention

This invention relates to docks suitable for use in loading, unloading or storing containers of liquids or other flowable or hazardous materials, and more particularly, to a modular dock system having a plurality of interconnected dock modules and an integrated secondary containment system. Optionally, a modular dock bumper assembly is desirably provided along one side of the dock system to protect the dock from damage by trucks, forklifts, or the like.

2. Description of Related Art

Conventional loading, unloading and storage docks or platforms are typically permanent installations made of reinforced concrete or steel, with bumper assemblies comprising wood or rubber strips adapted to protect the edge of the dock from damage by trucks, forklifts, or the like. Where the materials being handled or stored on the dock or platform include solvents, oils, greases, chemicals or other hazardous materials, particularly liquids, it is necessary to incorporate drains or catch basins when constructing the dock. For containment purposes in the event of spillage or leakage, the dock surface must slope toward the drain or must otherwise be constructed in such manner that spilled material will run into a drain system that is isolated from sewers and groundwater. Such dock installations are time consuming and expensive to construct.

Modular stages, platforms, floors, landings, boat docks and piers have previously been disclosed that contain a plurality of panels which are interconnected to produce a substantially continuous, larger surface. U.S. Pat. No. 3,999,397 discloses a modular dock system comprising panels adapted to be interconnected into a pier. Each dock panel comprises a plurality of elongated, extruded aluminum panel members arranged in side by side relation with a slight spacing provided between adjacent edges of the panel members. Thin sheets of plastic material are adhesively secured to the upper surface of the upper walls of the panel members. The dock panels are supported on "H-type" frames or saddles.

U.S. Pat. Nos. 4,580,776 and 4,912,887 disclose collapsible stages. U.S. Pat. No. 4,104,835 discloses portable staging equipment comprising interlocking units having rectangular frames, folding tubular legs, joists, and drop-in panels.

U.S. Pat. No. 4,759,162 discloses a modular platform assembly with interlocking deck sections, preferably four feet by four feet square, having rectangular frames, adjustable tubular legs and plywood sheeting.

U.S. Pat. No. 4,676,036 discloses a multi-tiered floor for a computer room, comprising a series of vertical support members and horizontal connectors arranged in generally rectangular shape onto which removable flooring surfaces are placed to define a plurality of separated plenum spaces for containing selected conductors and conduits.

U.S. Pat. No. 5,214,817 discloses a modular ramp and walkway ramp assembly made from a plurality of similarly sized pre-manufactured, concrete-filled, rectangular panels. A support post with an angularly arranged bracket is placed beneath the corners of adjacent panels to secure them together and support them.

A dock system is therefore needed that is strong, that can be quickly assembled or disassembled, and that embodies a secondary containment capability. A dock system is also needed that can be utilized for loading, unloading or storage in either temporary or permanent service.

SUMMARY OF THE INVENTION

The modular dock system disclosed herein preferably provides a stable platform for loading, unloading or storing liquids or other flowable materials such as, for example, solvents, oils, greases, chemicals and the like that are packaged in drums, cans or other such containers.

According to one embodiment of the invention, a modular dock system is provided that preferably comprises a plurality of interconnected dock modules in combination with a secondary containment system. According to one preferred embodiment of the invention, a modular dock bumper assembly is also provided as part of the modular dock system.

According to another preferred embodiment of the invention, a modular dock system is provided that comprises a plurality of rigidly interconnected dock modules, each module having a frame for supporting a horizontal grate around its periphery; legs attached to the frame for maintaining the frame a desired distance above an underlying support surface; means for interconnecting the legs of adjacent modules to maintain the modules in a fixed, preferably abutting, position relative to each other; and a secondary containment means underlying the grate that is adapted to receive liquid spillage or leakage from containers stacked on, stored on, or transported over, the dock.

According to a particularly preferred embodiment of the invention, the secondary containment means comprises a drain pan suspended beneath the grate from the frame of each module. The drain pan preferably comprises a sloped bottom having an outlet port that is connected to a network of pipes or tubing adapted to collect liquid spillage or leakage.

According to another embodiment of the invention, a modular dock bumper assembly is provided to protect the interconnected dock modules of the invention from damage or dislocation due to impact from a truck, forklift, or the like.

BRIEF DESCRIPTION OF THE DRAWINGS

The apparatus of the invention is further described and explained in relation to the following figures of the drawings wherein.

Like reference numerals are used to indicate like parts in all figures of the drawings.

DESCRIPTION OF THE PREFERRED EMBODIMENTS

Figure 1:
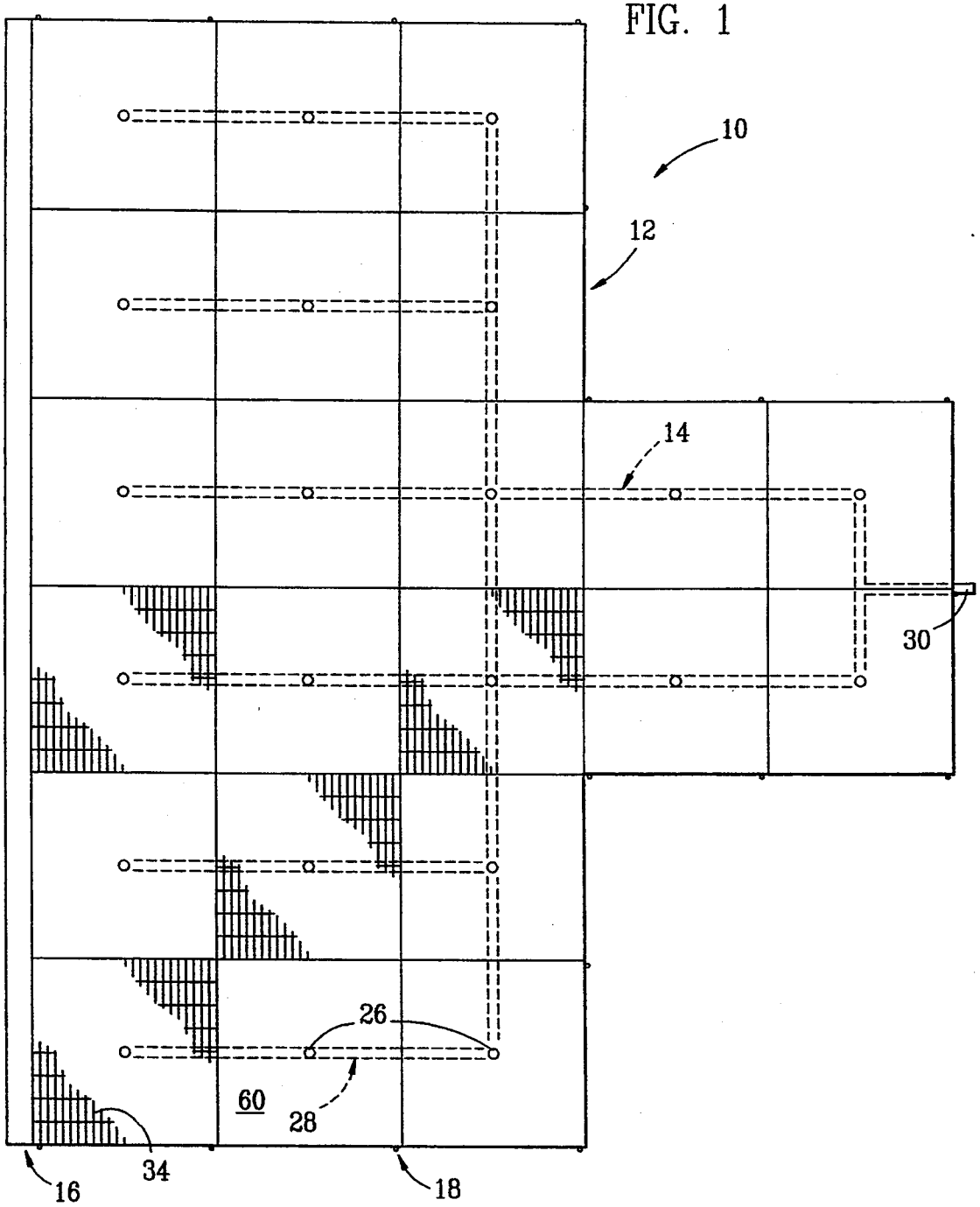
FIG. 1 a plan view of a preferred embodiment of the modular dock system of the invention.
Figure 1A:
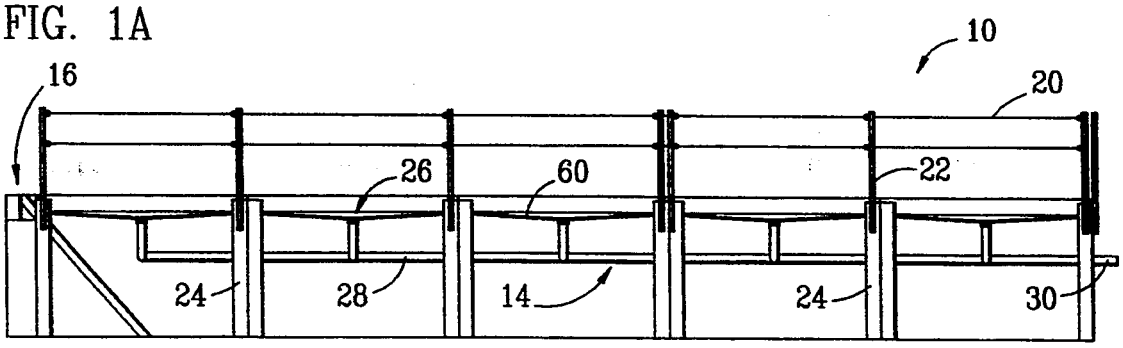
FIG. 1A is an elevation view of the modular dock system of FIG. 1.
Figure 2:
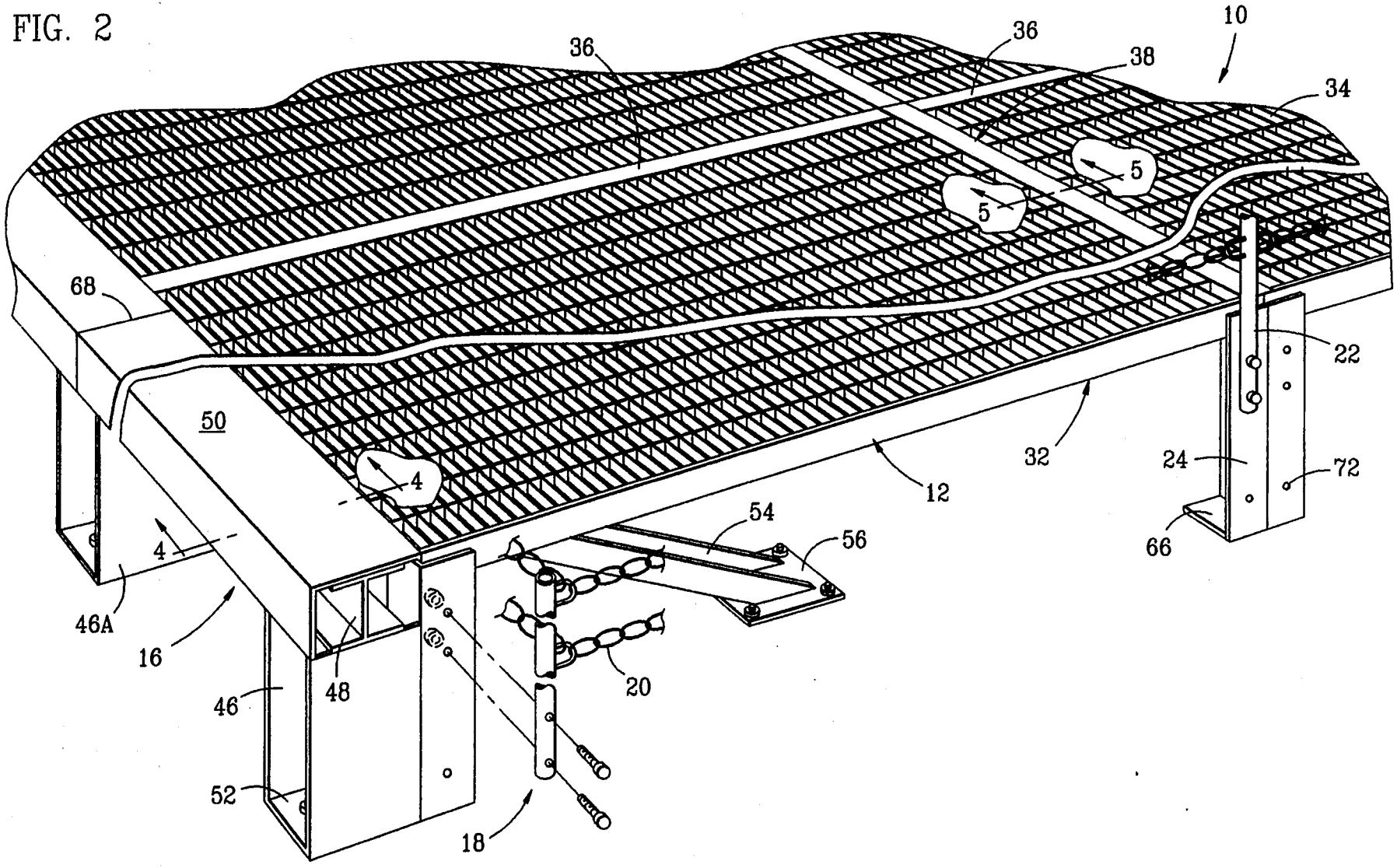
FIG. 2 is a perspective view, partially broken away of the lower left-hand corner of the modular dock system of FIG. 1.

Referring to FIGS. 1 and 1A, a simplified schematic drawing, modular dock system 10 of the invention preferably comprises a plurality of interconnected dock modules 12, secondary containment system 14, and modular dock bumper assembly 16. Dock modules 12, supported by legs 24, are preferably rectangular or square, and can be arranged in any desired configuration, although configurations where each module has at least two sides interconnected to adjacent modules are preferred for imparting strength and rigidity to modular dock system 10. Use of the modular dock bumper assembly 16 in system 10 is preferred to reduce the likelihood of damage to or dislocation of interconnected dock modules 12 by vehicles such as trucks, forklifts, or the like, but is not required for practicing the invention.

Figure 3:
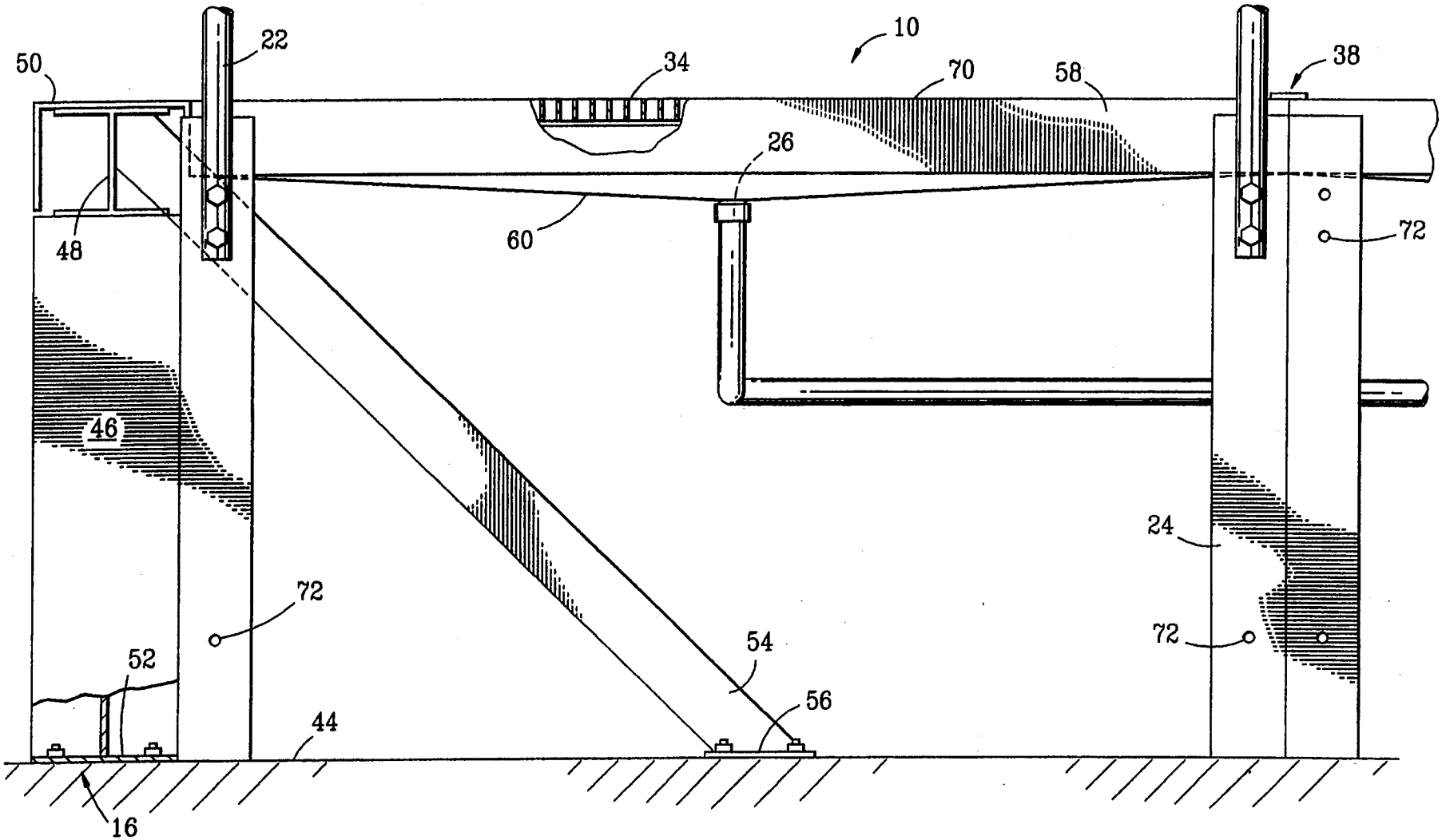
FIG. 3 is an enlarged detail view, partially broken away and partially in section, of the left end of the modular dock system as depicted in FIG. 1A.
Figure 4:
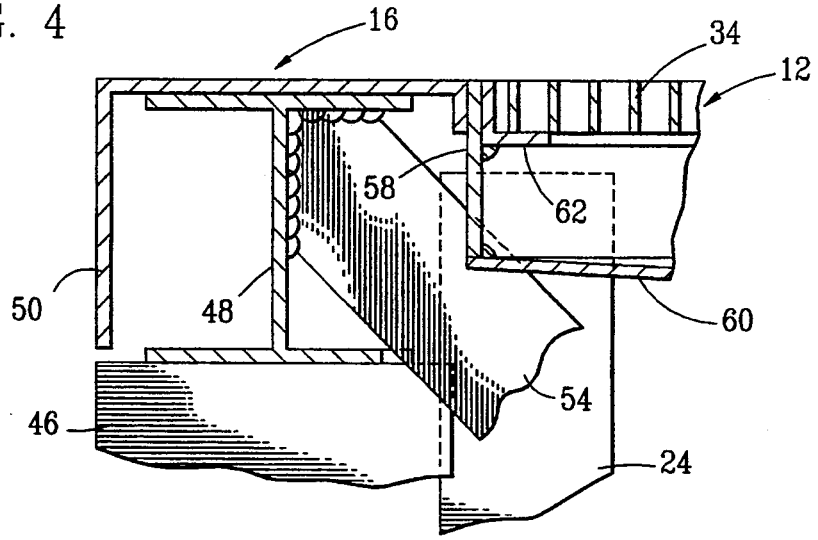
FIG. 4 a detail elevation view, partially in cross-section and partially broken away, taken along line 4—4 of FIG. 2.
Figure 5:
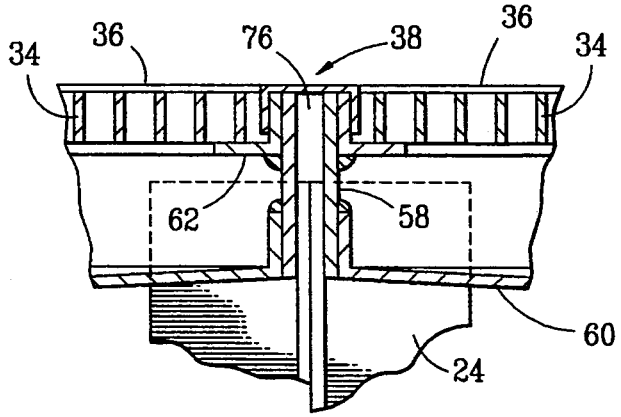
FIG. 5 is a detail elevation view, partially in cross-section and partially broken away, taken along line 5—5 of FIG. 2.

Referring to FIGS. 1, 1A and 3, secondary containment system 14 preferably further comprises secondary ,containment means such as drain pans 60 on each dock module 12, each drain pan 60 having a bottom sloped toward drain 26, and piping or tubing 28 interconnecting drains 26 and providing fluid communication between drains 26 and outlet 30. Piping or tubing 28 is preferably made of PVC, although copper or another suitable material may be preferred where the liquid comprises harmful organic or corrosive substituents. Although not shown in the drawings, it is understood that secondary containment system 14 can also comprise such conventional valves and other flow control devices as may be desired. Similarly, although not part of the invention and not shown in the drawings, outlet 30 of secondary containment system 14 is desirably connected to a holding tank or other similarly effective means for containing spillage or leakage until the materials ,can be recycled, further processed or otherwise safely disposed of.

A safety system 18 preferably extends around any portion of the periphery of modular dock system 10 that is not bounded by a wall or by modular dock bumper assembly 16. As shown in FIG. 1A, safety system 18 comprises posts 22 supported by legs 24 and linked by chains 20, although it will be apparent that other conventional, commercially available means can likewise be used if needed or desired.

Dock modules 12 and modular dock bumper assembly 16 are further described and explained in relation to FIGS. 2–5. Each dock module 12 is preferably made of metal, and comprises a rectangular, most preferably square, horizontal frame defined by four side walls 58 that are connected by welding or other similarly effective means to cream a unitary structure. Although the dimensions of dock module 12 can vary, preferred side dimensions range from about 48 to about 60 inches, and most preferably about 56 inches. Dock modules 12 of this size are preferred for use in modular dock system 12 of the invention because they can be easily handled, transported and stored. Also, if dock modules 12 are made with significantly larger dimensions, modular dock system 10 will be less rigid due to the greater distance between legs 24, and additional bracing or structural reinforcement may be required to maintain the desired stability and/or to support grate 34. Angle irons 62 and grate 34 are preferably sized and positioned so that grates 34 and top edges 70 of side walls 58 cooperate to define a substantially level horizontal work surface for dock system 10. Drain pan 60 is preferably welded to the lower inside portion of side walls 58 of dock module 12, and desirably spans the entire area beneath grate 34 to provide secondary containment if material leaks or spills from containers loaded, unloaded, stored or transported on or over modular dock system 10.

Each corner of dock module 12 preferably comprises a leg 24 that comprises a length of angle iron having dimensions, for example, of about 2"×2" and a length sufficient to elevate the frame a predetermined height above a support surface 44 (FIG. 3) that is preferably not greater than the length of one side of the module. According to a particularly preferred embodiment of the invention, the length of legs 24 is about half the length of one side of dock module 12. A base plate 66 having dimensions equal to the side dimensions of leg 24 is preferably welded to the bottom of each leg 24, and a plurality of vertically spaced holes 72 are provided to permit the insertion of bolts when interconnecting the legs 24 of adjacent dock modules 12 during the assembly of modular dock system 10. If desired, base plates 66 can be drilled for use in attaching leg 24 of dock module 12 to support surface 44, although such attachment is not generally required, particularly where the dimensions of modular dock system 10 are such that numerous interconnected dock modules 12 are needed. Legs 24 are preferably attached to the frame of dock module 12 by positioning them over the outside of the corners formed by abutting side walls 58 and by welding the top portion of leg 24 to side walls 58. Alternatively, legs 24 can be bolted to side walls 58 provided that the bolt size and spacing provides adequate structural integrity and shear resistance when modular dock system 10 is subjected to a load.

Modular dock bumper assembly 16 is preferably a free-standing unit and is intended to protect modular dock system 10 from damage due to slight or moderate impact such as might be experienced, for example, when a truck or forklift bumps into the dock while onloading or offloading pallets, drums or containers. Modular dock bumper assembly 16 preferably comprises a plurality of horizontally spaced-apart vertical members 46 having base plates 52 secured to underlying support surface 44 by bolts or the like, and one or more transverse members 48 providing an interconnection between vertical members 46. Protective cover 50 desirably covers the front and top of transverse member 48, and preferably has a top surface at substantially the same level as grates 34 of dock modules 12. Protective cover 12 can be made of sheet steel, or of any other material that is suitable for the intended use environment. According to a preferred embodiment of the invention, vertical members 46 and transverse member 48 are steel 1-beams segments that are welded together to produce a unitary structure. If desired for ease of transport, handling and installation, modular dock bumper assembly 16 can be fabricated in segments of a shorter predetermined length (shorter than the length of the side of modular dock system 10 that assembly 16 is intended to protect) provided that the resultant structure is strong and rigid enough to provide the desired degree of protection. The spacing between vertical members 44 does not have to correspond to the dimensions of dock modules 12, and dock modules 12 may simply abut modular dock bumper assembly 16 without being connected thereto. As indicated in the embodiment shown in FIG. 2, transverse member 48 and protective cover 50 are segmented to overlap about half the width of vertical member 46A, thereby providing space for positioning another transverse member in end-to-end alignment with the first transverse member 48. A plurality of inclined steel braces 54 are desirably connected by welding or other similarly effective means to transverse members 48 at desired intervals along modular dock bumper assembly 16 to provide additional structural support against impact. Braces 54 are preferably I-beams or pipes with base plates 56 that can be bolted or otherwise secured to an underlying support surface.

Figure 6:
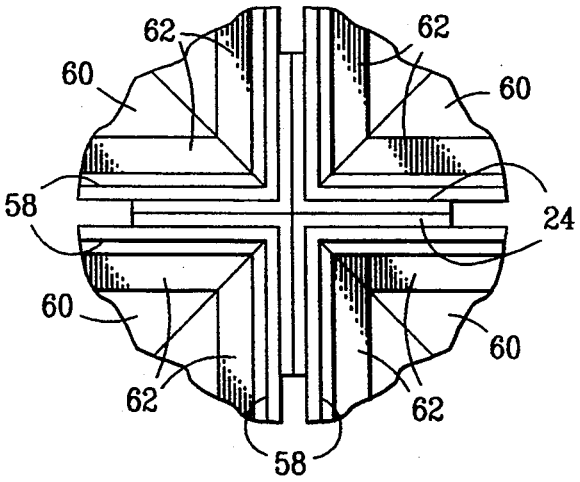
FIG. 6 a detail plan view of the corners of four adjacent dock modules (without the metal gram) positioned so that their abutting legs can be interconnected.
Figure 7:
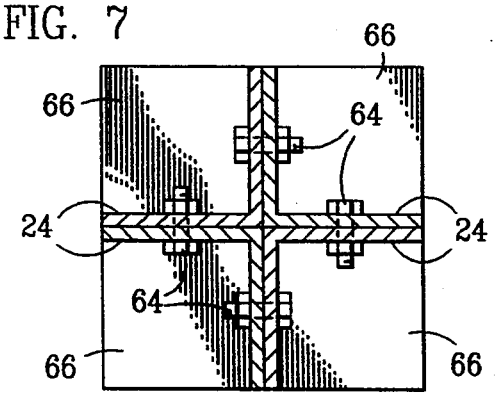
FIG. 7 is a cross-sectional plan view through the legs of the four adjacent dock modules after they are bolted together.
Figure 8:
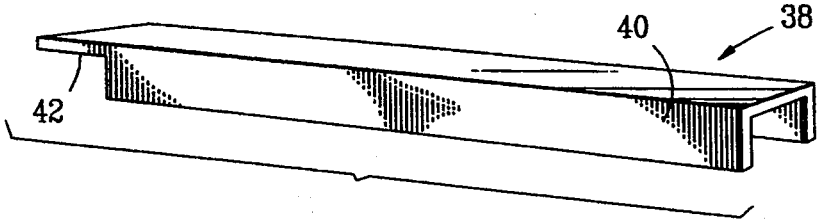
FIG. 8 is a detail perspective view of an inverted U-shaped channel member having an outwardly extending tab adapted to cover the void above the abutting legs of four adjacent, interconnected dock modules.

The preferred means for interconnecting adjacent dock modules 12 when assembling modular dock system 10 of the invention are further described and explained in relation to FIGS. 2, 3 and 5–8. FIG. 6 is a detail plan view of the relative positions of four adjacent dock modules 12 (with grates 34 removed) just prior to interconnection during the assembly of modular dock system 10 of the invention. As seen in FIG. 6, the adjacent legs 24 of four separate dock modules are placed in abutting contact, with holes 74 being aligned to permit the insertion of bolts therethrough. FIG. 7, a cross-sectional view taken through four interconnected legs 24 below side walls 58, shows bolts 64 connecting the four legs 24 to form a unitary structure.

When adjacent dock modules 12 are joined in this manner, horizontally extending slots 76 (visible in FIGS. 5 and 6) are created between side walls 58 of adjacent dock modules 12 due to the thickness of legs 24. A square void is also created above the four interconnected legs 24 as seen in FIG. 7. If these slots and voids are not covered, the possibility exists that leaked or spilled materials might run down between adjacent dock modules 12, thereby bypassing the secondary containment means and falling to the underlying support surface. According to a preferred embodiment of the invention, slots 76 are covered by channel members 36 (visible in FIGS. 2 and 5) and by specially modified channel members 38 (visible in FIGS. 2, 5 and 7). Channel members 36 and 38 preferably each comprise an inverted U-shaped channel segment having a length slightly less than the inside dimension between the vertically extending portions of the grate support means (such as angle irons 62) at opposite ends of the slot 76 which it is intended to cover. Specially modified channel members 38 comprise inverted U-shaped section 40 and further comprise a horizontally extending tab 42 adapted to cover the square void created above the points of intersection where the legs 24 of four adjacent dock modules 12 are interconnected. In this preferred embodiment of the invention, channel members 36 and 38 thereby cooperate to form part of the secondary containment system 14 of modular dock system 10.

Other alterations and modifications of the invention will likewise become apparent to those of ordinary skill in thee art upon reading the present disclosure, and it is intended that the scope of the invention disclosed herein be limited only by the broadest interpretation of the appended claims to which the inventors are legally entitled.

We claim:

1. A modular dock system comprising a plurality of interconnected dock modules, each dock module further comprising a horizontally disposed rectangular frame with a leg at each corner thereof and means for interconnecting each leg to a leg of at least one adjacent dock module to prevent relative motion therebetween, grate support means connected to the frame, a grate, liquid containment means underlying the grate, and a drain in the liquid containment means; and means for receiving and collecting liquid from the drains of the plurality of interconnected dock modules.

2. The modular dock system of claim 1 wherein the rectangular frame is square.

3. The modular dock system of claim 1 wherein the legs have an angular cross section.

4. The modular dock system of claim 3 wherein each angular section of the legs of each dock module comprises a plurality of vertically spaced holes, and wherein bolts are inserted through the holes to interconnect the legs of adjacent dock modules.

5. The modular dock system of claim 1 wherein the liquid containment means of each dock module is a drain pan with a sloped bottom that is suspended from the rectangular frame.

6. The modular dock system of claim 1 wherein the means for receiving and collecting liquid from the drains of the interconnected dock modules comprises a network of piping providing fluid communication between the drains and a common outlet.

7. The modular dock system of claim 1, further comprising a plurality of elongate, inverted U-shaped channel members bridging the frames of adjacent interconnected dock modules.

8. The modular dock system of claim 1, further comprising a freestanding modular dock bumper assembly connected to an underlying support surface and having a height substantially the same as that of the dock modules.

9. The modular dock system of claim 8 wherein the modular dock bumper assembly comprises a plurality of horizontally aligned, spaced-apart vertical support members, at least one transverse member spanning between adjacent vertical support members and connected thereto, and a plurality of inclined brace members extending obliquely downward to the underlying support surface.

10. A dock module comprising a horizontally disposed rectangular frame with a leg at each corner thereof and means for interconnecting each leg to a leg of at least one adjacent dock module to prevent relative motion therebetween, grate support means connected to the frame, a grate, liquid collection means underlying the gram, and a drain for the liquid collection means.

11. The dock module of claim 10 wherein the rectangular frame is square.

12. The dock module of claim 10 wherein the legs have an angular cross section.

13. The dock module of claim 10 wherein the means for interconnecting each leg to a leg of at least one adjacent dock module comprises a plurality of vertically spaced holes.

14. The dock module of claim 1 wherein the liquid collection means is a drain pan with a sloped bottom that is suspended from the rectangular frame.

* * * * *

UNITED STATES PATENT AND TRADEMARK OFFICE

CERTIFICATE OF CORRECTION

PATENT NO. : 5,408,790

DATED : APRIL 25, 1995

INVENTOR(S) : MARK HOESTEN AND STEPHEN J. SPENCER

It is certified that error appears in the above-identified patent and that said Letters Patent is hereby corrected as shown below:

COLUMN 3, LINE 2:

After metal, delete [gram] and insert --grate--.

COLUMN 3, LINE 33:

Delete [,].

COLUMN 3, LINE 49:

Delete first [,].

Signed and Sealed this

Nineteenth Day of September, 1995

*Attest:*

Bruce Lehman

BRUCE LEHMAN

*Attesting Officer*

*Commissioner of Patents and Trademarks*